US005374008A

United States Patent [19]

Halvorson, deceased et al.

[11] Patent Number: 5,374,008

[45] Date of Patent: Dec. 20, 1994

[54] SPINDLE FOR A ROLLED MATERIAL DISPENSER

[75] Inventors: Harlan Halvorson, deceased, late of Wells; Nona R. Boyes, legal representative, Faribault, both of Minn.

[73] Assignee: Barr, Inc., Wells, Minn.

[21] Appl. No.: 675,011

[22] Filed: Mar. 18, 1991

Related U.S. Application Data

[63] Continuation of Ser. No. 466,719, Jan. 16, 1990, abandoned.

[51] Int. Cl.[5] ..... B65H 19/00

[52] U.S. Cl. ..... 242/598.3; 242/599.1

[58] Field of Search ..... 242/55.2, 55.3, 55.53; D6/522, 523

[56] References Cited

U.S. PATENT DOCUMENTS

| | | | |
|---|---|---|---|
| 609,228 | 8/1898 | Clarke | 242/55.2 |
| 960,363 | 6/1910 | Marshall | 242/55.2 |
| 972,667 | 10/1910 | Wheeler | 242/68.5 |
| 1,023,939 | 4/1912 | Kaufman | 242/55.2 |
| 1,354,170 | 9/1920 | Cook | 242/55.2 |
| 1,851,722 | 3/1932 | Moore | 242/55.2 |
| 1,888,426 | 11/1932 | Duby | 242/55.2 |
| 2,410,328 | 10/1946 | Agamaite, Jr. | 242/55.2 |
| 3,214,014 | 10/1965 | Perrin | 242/68.5 |
| 4,102,510 | 7/1978 | Anderson | 242/55.2 |
| 4,212,434 | 7/1980 | Walker | 242/55.2 |
| 4,344,583 | 8/1982 | Drum | 242/55.2 |
| 4,487,378 | 12/1984 | Kobayashi | 242/68 |
| 4,487,387 | 12/1984 | Heath | 248/59 |
| 4,535,947 | 8/1985 | Hidle | 242/55.2 |
| 4,767,074 | 8/1988 | Bower | 242/55.2 |

*Primary Examiner*—Daniel P. Stodola

*Attorney, Agent, or Firm*—Peterson, Wicks, Nemer & Kamrath

[57] ABSTRACT

An spindle (10) for use in a dispenser (12) for rolled material such as toilet paper includes a core (30) having a length to extend between the inside surfaces (22, 24) of the dispenser (12). The first end (32) of the core (30) is held in the dispenser recess (26) by a plug (34) threadably received therein. The second end (38) of the core (30) is held in the dispenser recess (28) by a sleeve (40) telescopically received therein and which is biased outwardly by a compression spring (56). Access to the sleeve (40) is provided only at a location intermediate the ends (32, 38) and which is overlain by the rolled material while access to the sleeve (40) is effectively prevented adjacent the second end (38) of the core (30) and the dispenser recess (28). In the most preferred form, a longitudinal slot (54) is formed in the core (30) to allow access to the sleeve (40) and specifically to a tab (48) formed on the sleeve (40) having a detent (50) which extends into the slot (54). Thus, in order to remove the spindle (10) from the dispenser (12), it is necessary to remove the rolled material to obtain access to the tab (48) and detent (50) of the sleeve (40) through the slot (54) to allow removal of the sleeve (40) from the dispenser recess (28).

20 Claims, 1 Drawing Sheet

SPINDLE FOR A ROLLED MATERIAL DISPENSER

This is a continuation of copending application Ser. No. 07/466,719 filed on Jan. 16, 1990, now abandoned.

BACKGROUND

The present invention generally relates to rolled material dispensers and particularly to an improved spindle for existing dispensers for rolled material such as toilet paper.

Unauthorized removal of toilet paper from dispensers is a major problem in commercial and public restrooms. Specifically, increased costs result from theft of toilet paper from such restrooms. Further, the toilet paper is often used in vandalism in the restrooms or in adjacent areas, resulting in additional cost for cleaning or repair. Various approaches exist to prevent or reduce unauthorized removal of toilet paper from dispensers. Many of these approaches involve specially designed dispensers including locking systems having keys. Such approaches were generally disadvantageous because they may not be utilized in existing dispensers and generally required the use of keys or the like by restroom maintenance personnel to place toilet paper in the dispensers.

Another problem faced in commercial and public restrooms is the premature replacement of partial toilet paper rolls with new rolls. Thus, the costs of toilet paper for the restroom are increased because of the inefficient use of less than the entire roll.

Thus, a need has arisen for dispensers which prevent the unauthorized removal of toilet paper and like rolled material which does not require keys or the like and which is of a simple construction. Further, a need has arisen for a method for preventing unauthorized removal of toilet paper which may be utilized in existing dispensers without replacement. Additionally, a need has arisen for a dispenser which prevents premature replacement of partial rolls of rolled material with new rolls.

SUMMARY

The present invention solves these needs and problems in the dispensing of rolled material such as toilet paper by providing, in its most preferred form, an improved spindle extending between and held by recesses formed in the side members of a rolled material dispenser. The spindle includes a sleeve telescopically received in the second end of a core having a length generally equal to the spacing between the side members. The sleeve is biased to telescope from the core such that the first end of the core and the sleeve are held by the recesses of the side members of the dispenser. Access to the sleeve is provided only at a location intermediate the core and which is overlain by the rolled material while access to the sleeve is effectively prevented adjacent the second end of the core and the second side member. Therefore, in order to remove the spindle from the dispenser, it is necessary to remove the rolled material to obtain access to the sleeve to allow its removal from the recess of the side member.

It is thus an object of the present invention to provide a novel spindle for use in a dispenser for dispensing rolled material.

It is further an object of the present invention to provide such a novel spindle which effectively prevents the unauthorized removal of the rolled material.

It is further an object of the present invention to provide such a novel spindle which effectively prevents premature replacement of partial rolls of rolled material.

It is further an object of the present invention to provide such a novel spindle not requiring keys or the like.

It is further an object of the present invention to provide such a novel spindle which is of simple construction.

It is further an object of the present invention to provide such a novel spindle which may be utilized in existing dispensers without modification thereto.

It is further an object of the present invention to provide such a novel spindle which is adjustable to fit different dispensers.

These and further objects and advantages of the present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figure 1:
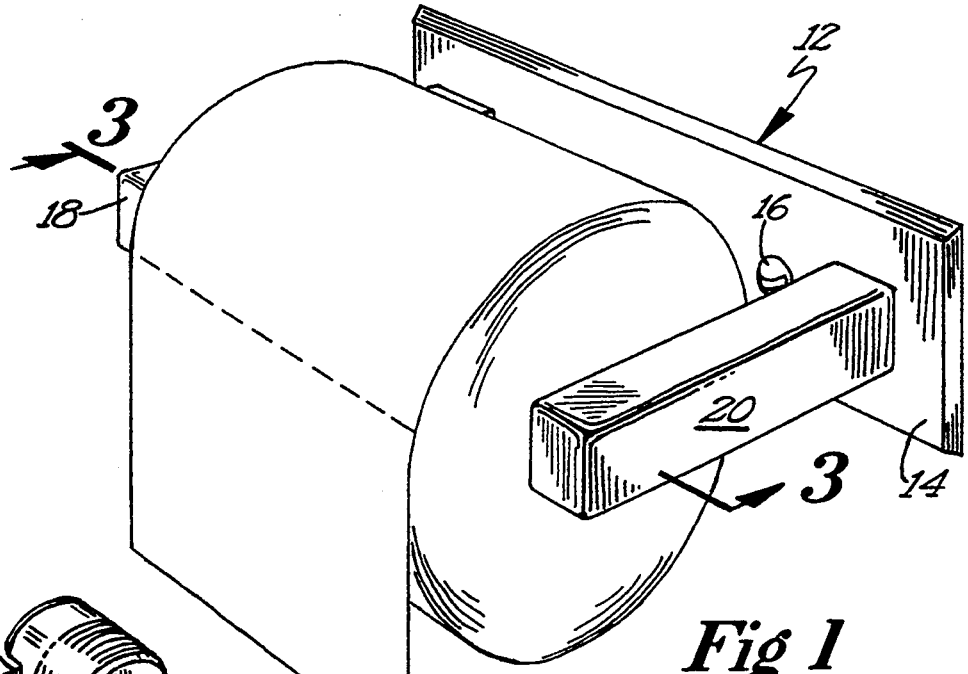
FIG. 1 shows a perspective view of a toilet paper dispenser utilizing a spindle according to the preferred teachings of the present invention.
Figure 2:
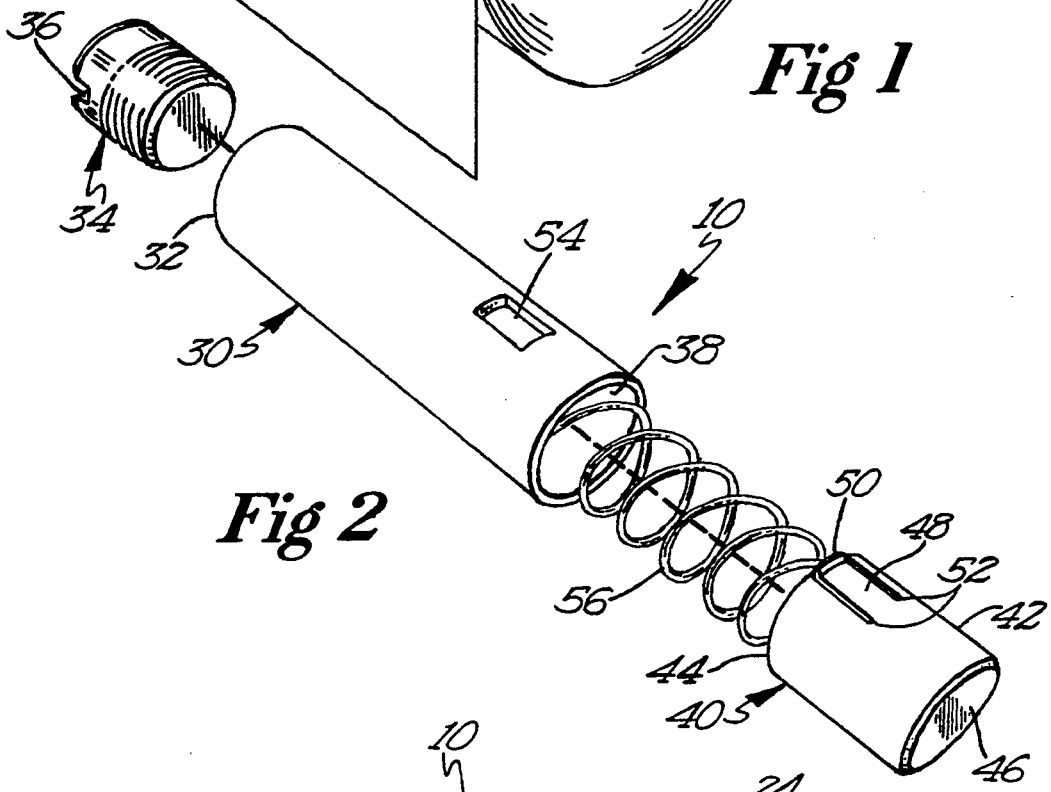
FIG. 2 shows an exploded perspective view of the spindle of FIG. 1.
Figure 3:
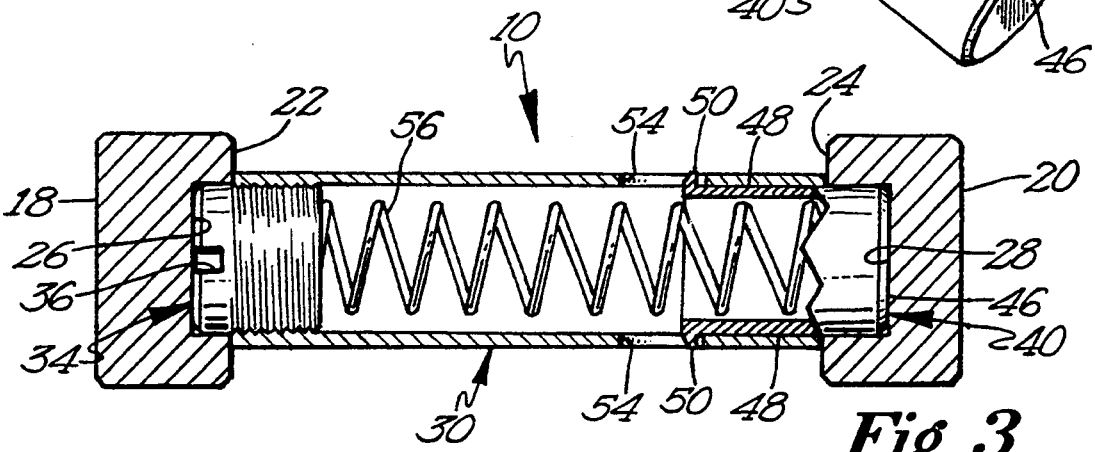
FIG. 3 shows a cross-sectional view of the dispenser and spindle of FIG. 1 according to section line 3—3 of FIG. 1.

All figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "end", "free", "side", "surface", "longitudinally", "inside", and similar terms are used herein, it should be understood that these terms have reference only to the structure shown in the drawings as it would appear to a person viewing the drawings and are utilized only to facilitate describing the invention.

DESCRIPTION

An improved spindle for a dispenser for dispensing rolled material such as toilet paper is shown in the drawings and generally designated 10. Dispenser 12 can be of a variety of conventional forms, an example of which is shown in FIG. 1. Dispenser 12 generally includes a base 14 adapted to be secured by any desired means such as screws 16 shown to a wall or other support. Side members shown in the preferred form of parallel arms 18 and 20 project from base 14 to form sides of dispenser 12. The inside surfaces 22 and 24 adjacent the free ends of arms 18 and 20 facing each other include cylindrical recesses 26 and 28 having a shape, size, and depth. The rolled material is rotatably supported on and by spindle 10 which extends into and is supported by recesses 26 and 28 of arms 18 and 20. It can be realized that dispenser 12 can have other forms according to the teachings of the present invention in addition to the form as shown and described.

Spindle 10 according to the preferred teachings of the present invention includes a cylindrical or tubular core 30 having a circular cross section which is complementary to but slightly larger than recesses 26 and 28 and having a length generally equal to but slightly less than the spacing between surfaces 22 and 24 of arms 18 and 20. The first open end 32 of core 30 is held in first recess 26 of arm 18 and is closed by a plug 34. Plug 34 is formed on core 30 in the preferred form by adjustably mounting it to core 30 and in the most preferred form by threadably receiving plug 34 in end 32 of core 30. Plug 34 is cylindrical, has a shape and size complementary to and for slideable receipt in recess 26 of arm 18, and has a length sufficient to extend from end 32 of core 30 into recess 26. In its most preferred form, the free end of plug 34 includes a diagonal slot 36 for receiving a coin to allow rotation of plug 34 into or out of end 32 of core 30.

Telescopically received within the second open end 38 of core 30 is sleeve 40. Sleeve 40 is cylindrical, has a cross-section having a shape and size complementary to but smaller than core 30, and has a shape and size complementary to and for slideable receipt in recess 28 of arm 20. Sleeve 40 generally includes cylindrical sidewall 42 having a first open end 44 which is located intermediate ends 32 and 38 of core 30 when sleeve 40 is telescopically received within core 30 and having a second closed end 46 for receipt in recess 28 of arm 20. Sleeve 40 further includes first and second longitudinally extending tabs 48 having free ends opposite to closed end 46 and including detents 50. In the most preferred form, tabs 48 are formed by cutting sidewall 42 along two parallel cuts 52 extending longitudinally from open end 44 to a location spaced from closed end 46. Detent 50 is formed in the most preferred form by bending the free end of tab 48 outwardly. Detents 50 are slideably received in longitudinally elongated slots 54 formed in core 30 intermediate ends 32 and 38. It can then be appreciated that end 44 of sleeve 40 is accessible at slots 54 intermediate ends 32 and 38 of core 30.

For biasing sleeve 40 to telescope from open end 38 of core 30, a compression spring 56 is provided in the most preferred form extending between plug 34 and closed end 46 inside of core 30 and sleeve 40.

Now that the construction and components of spindle 10 according to the preferred teachings of the present invention have been set forth, the use and subtle features of spindle 10 can be explained and appreciated. For purposes of explanation, it will be assumed that spindle 10 is removed from dispenser 12. It can be appreciated that although spring 56 biases sleeve 40 out of core 30, detents 50 of sleeve 40 abut the ends of slots 54 adjacent end 38 of core 30 to prevent sleeve 40 from sliding out of core 30. Thus, spindle 10 is a single piece which is not normally separated in the preferred form of the present invention.

After a roll of toilet paper has been placed upon spindle 10, spindle 10 can be angled in dispenser 12 such that plug 34 is aligned with and inserted into recess 26 of arm 18 and the toilet paper is located intermediate arms 18 and 20. Sleeve 40 may then be telescoped within core 30 by pressing on end 46 until end 46 of sleeve 40 is located generally within or coplanar with end 38 of core 30. At that time, spindle 10 can be pivoted within dispenser 12 about plug 34 in recess 26 until end 46 of sleeve 40 inside of core 30 extends partially over inside surface 24 of arm 20. Pressure may then be removed from sleeve 40 as arm 20 will hold sleeve 40 within core 30. Spindle 10 can then be continued to be pivoted within dispenser 12 until open end 38 and sleeve 40 are aligned with recess 28 of arm 20. Due to the biasing of sleeve 40 within core 30 by spring 56, sleeve 40 will telescope from open end 38 of core 30 into recess 28 of arm 20.

It can then be appreciated that with the toilet paper roll in place on spindle 10, spindle 10 according to the teachings of the present invention can not be removed from dispenser 12 to thus prevent removal of the toilet paper roll therefrom. Specifically, the toilet paper roll overlies slots 54 of core 30 and detents 50 of sleeve 40 located therein to prevent sleeve 40 from being telescoped in core 30 by pushing against detents 50. It can then be appreciated that slots 54 and detents 50 are designed to be intermediate ends 32 and 38 at a location to prevent finger access through the space between the core of the toilet paper roll and core 30. It can be further appreciated that in many dispensers, arms 18 and 20 or other members in which recesses 26 and 28 are located generally abut with the toilet paper roll and thus block the space between the core of the toilet paper roll and core 30 to thus prevent or otherwise restrict access thereto.

Due to the length of core 30 being generally equal to the spacing between surfaces 22 and 24 of arms 18 and 20, limited or restricted access effectively prevents access to sleeve 40 between end 38 of core 30 and surface 24 of arm 20. Thus, due to this limited or restricted access, it is not possible to telescope sleeve 40 into core 30 with a finger or other object such as a screwdriver or knife. As long as sleeve 40 extends out of core 30 into recess 28 and is not telescoped therein, spindle 10 and the toilet paper roll thereon can not be removed from dispenser 12.

Spindle 10 according to the teachings of the present invention is further advantageous due to the adjustability provided by plug 34. Specifically, limited or restricted access to sleeve 40 is the result of the close proximity of open end 38 to inside surface 24 of arm 20 due to the preferred length of core 30. By turning plug 34 into or out of open end 32 of core 30, the effective length of core 30 or in other words the spacing of open end 38 from inside surface 24 can be adjusted to compensate for differences in spacing between surfaces 22 and 24 of arms 18 and 20 of the particular dispenser 12 in which it is desired to utilize spindle 10 according to the teachings of the present invention. It can be appreciated that even if plug 34 is turned out of end 32 a sufficient distance to space end 32 from inside surface 22 of arm 18 to allow access therebetween to plug 34 with an object such as a screwdriver, such access will not in any way facilitate telescoping sleeve 40 within core 30 which is required to remove spindle 10 from dispenser 12 according to the teachings of the present invention. Further, due to the generally cylindrical shape of recesses 26 and 28, core 30, plug 34, and sleeve 40, rotation of plug 34 relative to core 30 in order to shorten the effective length of core 30 while spindle 10 is located in dispenser 12 especially with a roll of toilet paper located thereon is effectively prevented.

After the toilet paper has been utilized from the roll, typically a paper core will remain on spindle 10 located in dispenser 12. This paper core may be torn by the maintenance personnel to expose detents 50. Access to sleeve 40 may then be obtained by pushing on detents 50 such that sleeve 40 may be telescoped into core 30 and out of recess 28 of arm 20 according to the teachings of the present invention, while sleeve 40 is within core 30, spindle 10 may be removed from between arms 18 and 20. At that time, any remaining portions of the paper core of the toilet paper roll can be removed from spindle 10 and a new roll of toilet paper placed on spindle 10 for placement in dispenser 12 according to the teachings of the present invention.

It can then be appreciated that unauthorized removal of a roll of toilet paper from dispenser 12 is prevented utilizing spindle 10 according to the teachings of the present invention. Specifically, as it is unlikely a potential thief will unroll the toilet paper from the roll, prevention of removal of the toilet paper roll with the paper core and/or toilet paper roll intact will effectively prevent theft of toilet paper. Further, maintenance personnel will be less likely to prematurely replace partial rolls of toilet paper with new rolls also due to the requirement that the paper core and any remaining toilet paper rolled thereon to be at least partially torn to obtain access to detents 50 to allow removal of spindle 10 according to the preferred teachings of the present invention.

Spindle 10 according to the teachings of the present invention will replace the telescoping style spindles currently utilized in various forms of existing dispensers 12. Thus, manufacturers of dispensers 12 can change over to utilize spindle 10 according to the teachings of the present invention with only minor capital costs. More importantly, spindles 10 according to the teachings of the present invention may be utilized in existing dispensers 12 which have been previously installed without modification thereto. Thus, it is not necessary to replace existing dispensers 12 to obtain the advantages of preventing unauthorized removal of toilet paper rolls.

Similarly, spindle 10 according to the teachings of the present invention is of a simple design which can be economically manufactured and assembled. Specifically, spindle 10 in its most preferred form may be formed in a similar manner as telescoping style spindles currently utilized. Further, it can be appreciated that the locks, keys, hinged portions, and other structures utilized in prior theft prevention dispensers are not required or utilized in the most preferred form of the present invention.

As it is necessary to at least partially tear the paper core of the toilet paper roll, it would be beneficial to utilize toilet paper rolls having easily tearable cores such as of the type shown in U.S. Pat. Nos. 972,667 and 3,214,014 to utilize coreless toilet paper rolls such as of the type shown in U.S. Pat. No. 487,378, or the like to reduce the time and effort of maintenance personnel to obtain access to detents 50 after the toilet paper has been spent from the roll.

Now that the basic teachings of the present invention have been explained, many extensions and variations will be obvious to one having ordinary skill in the art. For example, although spindle 10 has been shown and described in connection with dispensing toilet paper in the most preferred form, the teachings of the present invention may have application in the dispensing of other rolled material such as but not limited to paper towels.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. Spindle for use in a dispenser for dispensing rolled material, with the rolled material being rotatably supported on and by the spindle, with the dispenser including first and second side members having inside surfaces which face each other, with the inside surfaces of the first and second side members including first and second recesses, comprising, in combination: a one piece core having a first end and a second end; means attached to the first end of the core for slideable receipt in the first recess of the first side member; a sleeve telescopically received longitudinally in the second end of the core, with the sleeve having a first end for receipt in the second recess of the second side member and having a second end located intermediate the first and second ends of the core, with the longitudinal length between the first end and the second end of the core being fixed and substantially equal to the distance between the inside surfaces of the first and second side members and adapted to allow positioning the means for slideable receipt in the first recess within the first recess and positioning the core intermediate the inside surfaces of the first and second side members to allow telescoping of the sleeve into the second recess and with the first end of the core being adjacent to the first side member in a manner to prevent access to the means for slideable receipt in the first recess between the inside surface of the first side member and the first end of the core and with the second end of the core being adjacent to the second side member in a manner to prevent access to the sleeve between the inside surface of the second side member and the second end of the core, with the sleeve being accessible only at a location intermediate the first and second ends of the core which is overlain by the rolled material; and means for biasing the sleeve to telescope from the second end of the core, whereby in order to remove the spindle from the dispenser it is necessary to remove the rolled material from the spindle to obtain access to the sleeve to telescope the sleeve within the core and out of the second recess of the second side member.

2. The spindle of claim 1 wherein the core and the sleeve are cylindrical, with the inner surface of the core and the outer surface of the sleeve being of a substantially constant size throughout their longitudinal lengths, wherein access to the second end of the sleeve includes at least a first longitudinal slot located intermediate the first and second ends of the core for providing access to the sleeve telescopically received in the second end of the core.

3. The spindle of claim 2 wherein the sleeve includes a tab having a free end including a detent, with the detent extending through and longitudinally slideable within the slot for providing access to the sleeve and for abutting with an outer end of the slot to prevent the sleeve from telescoping out of the second end of the core, with the detent being longitudinally slideable within the slot by pushing against the detent longitudinally moving the detent away from the outer end of the slot to telescope the sleeve within the second end of the core.

4. The spindle of claim 3 wherein the means for slideable receipt in the first recess comprises a plug attached to the first end of the core.

5. The spindle of claim 4 wherein the plug is adjustably mounted relative to the first end of the core to change the effective, fixed longitudinal length of the core and the plug.

6. The spindle of claim 5 wherein the plug is threadably received within the first end of the core.

7. The spindle of claim 3 wherein the tab is formed by cutting the sleeve along two parallel cuts extending longitudinally from the second end to a location spaced from the first end; and wherein the detent is formed by bending the free end of the tab outwardly.

8. The spindle of claim 2 wherein the means for slideable receipt in the first recess comprises a plug attached to the first end of the core.

9. The spindle of claim 8 wherein the plug is adjustably mounted relative to the first end of the core to change the effective, fixed longitudinal length of the core and the plug.

10. The spindle of claim 9 wherein the plug is threadably received within the first end of the core.

11. The spindle of claim 1 wherein the means for slideable receipt in the first recess comprises a plug attached to the first end of the core.

12. The spindle of claim 11 wherein the plug is adjustably mounted relative to the first end of the core to change the effective, fixed longitudinal length of the core and the plug.

13. The spindle of claim 12 wherein the plug is threadably received within the first end of the core.

14. Spindle for use in a dispenser for dispensing rolled material, with the rolled material being rotatably supported on and by the spindle, with the dispenser including first and second side members having inside surfaces which face each other, with the inside surfaces of the first and second side members including first and second recesses having identical cross-sectional shapes of constant size, comprising, in combination: a tubular core having an inside surface, an outside surface, a first end, and a second end, with the longitudinal length between the first end and the second end of the core being substantially equal to the distance between the inside surfaces of the first and second side members, with the inside surface of the core having a cross section complementary to but slightly larger than the cross-sectional shapes of the recesses at the inside surfaces of the first and second side members; a plug including an outside surface having a cross section of a substantially constant size throughout its longitudinal length generally equal to but slightly smaller than the cross section of the core and of the first recess of the first side member for attachment to the inside surface of the first end of the core and for longitudinal slideable receipt in the first recess of the first side member; a sleeve including an outside surface having a cross section of a substantially constant size throughout its longitudinal length generally equal to but slightly smaller than the cross section of the core and of the second recess of the second side member for slideable receipt longitudinally within the inside surface of the second end of the core and for slideable receipt longitudinally within the second recess of the second side member, with the sleeve having a first end received in the second recess of the second side member and having a second end located intermediate the first and second ends of the core, with the sleeve being accessible only at a location intermediate the first and second ends of the core which is overlain by the rolled material while access is effectively prevented adjacent the second end of the core and the second side member; and means for biasing the sleeve to telescope longitudinally from the second end of the core, whereby in order to remove the spindle from the dispenser it is necessary to remove the rolled material from the spindle to obtain access to the sleeve to telescope the sleeve longitudinally within the core and out of the second recess of the second side member.

15. The spindle of claim 14 wherein the plug and the recesses are generally cylindrical in shape.

16. The spindle of claim 15 wherein the biasing means comprises a compression spring.

17. The spindle of claim 14 wherein the plug is adjustably mounted relative to the first end of the core to change the effective, fixed longitudinal length of the core and the plug.

18. The spindle of claim 17 wherein the plug is threadably received within the first end of the core.

19. The spindle of claim 14 wherein access to the second end of the sleeve includes at least a first slot located intermediate the first and second ends of the core for providing access to the sleeve telescopically received in the second end of the core; and wherein the sleeve includes a tab having a free end including a detent, with the detent extending through and longitudinally slideable within the slot for providing access to the sleeve and for abutting with an outer end of the slot to prevent the sleeve from telescoping out of the second end of the core, with the detent being longitudinally slideable within the slot by pushing against the detent longitudinally moving the detent away from the outer end of the slot to telescope the sleeve within the second end of the core.

20. The spindle of claim 19 wherein the tab is formed by cutting the sleeve along two parallel cuts extending longitudinally from the second end to a location spaced from the first end; and wherein the detent is formed by bending the free end of the tab outwardly.

* * * * *